US007666124B2

(12) United States Patent
Vaes

(10) Patent No.: US 7,666,124 B2
(45) Date of Patent: Feb. 23, 2010

(54) EXERCISE MACHINE

(76) Inventor: John Vaes, c/o 223 Avondale Street, Hamilton, Ontario (CA) L8L 7C4

( * ) Notice: Subject to any disclaimer, the term of this patent is extended or adjusted under 35 U.S.C. 154(b) by 776 days.

(21) Appl. No.: 11/071,265

(22) Filed: Mar. 4, 2005

(65) Prior Publication Data

US 2005/0202941 A1 Sep. 15, 2005

Related U.S. Application Data

(60) Provisional application No. 60/550,341, filed on Mar. 8, 2004.

(51) Int. Cl.
*A63B 21/062* (2006.01)

(52) U.S. Cl. ..... 482/101; 482/135; 482/94

(58) Field of Classification Search ..... 482/93, 482/92, 94, 138, 108, 135, 95–102, 140, 482/130

See application file for complete search history.

(56) References Cited

U.S. PATENT DOCUMENTS

| | | | | |
|---|---|---|---|---|
| 4,527,797 | A * | 7/1985 | Slade et al. | 482/101 |
| 4,542,899 | A * | 9/1985 | Hendricks | 482/102 |
| 5,215,510 | A * | 6/1993 | Baran | 482/104 |
| 5,669,859 | A * | 9/1997 | Liggett et al. | 482/94 |
| 5,971,897 | A * | 10/1999 | Olson et al. | 482/101 |
| 6,592,498 | B1 * | 7/2003 | Trainor | 482/97 |
| 7,094,185 | B2 * | 8/2006 | Greenland | 482/100 |
| 7,131,937 | B2 * | 11/2006 | Skilken et al. | 482/93 |
| 2003/0027695 | A1 * | 2/2003 | Lee | 482/99 |

* cited by examiner

*Primary Examiner*—Jerome Donnelly

(57) ABSTRACT

The present invention is an exercise machine which includes a moveable section connected to a frame such that the moveable section is independently and simultaneously moveable along an horizontal direction and vertical direction. The exercise machine further includes and a weight stack operably connected to the moveable section, such that the weight stack providing resistance to movement of the moveable section; and a frame operably supporting the moveable section and the weight stack.

9 Claims, 13 Drawing Sheets

158
148
170
160
124
212

Fig. -14
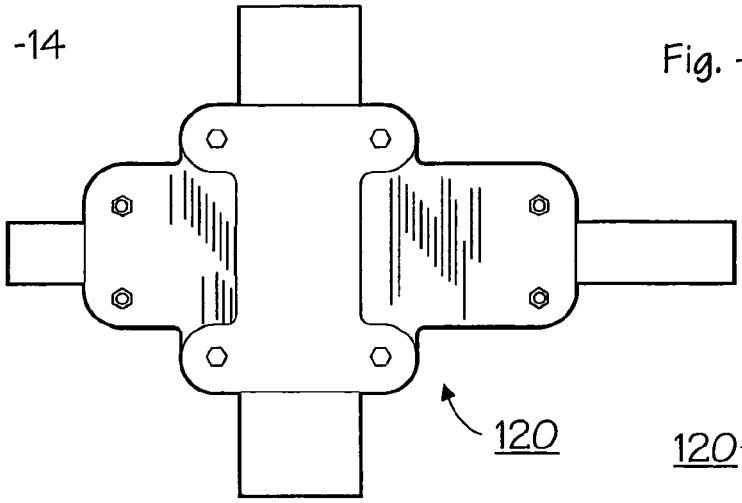
Fig. -15
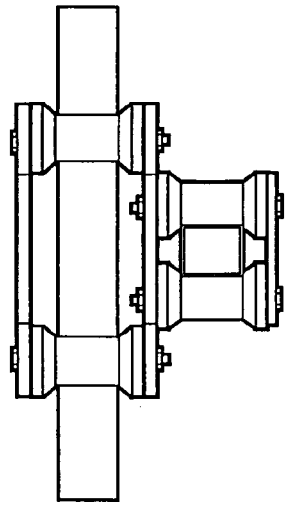
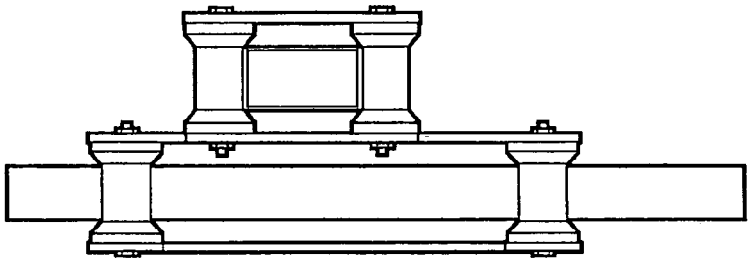
Fig. -16
120
Fig. -17
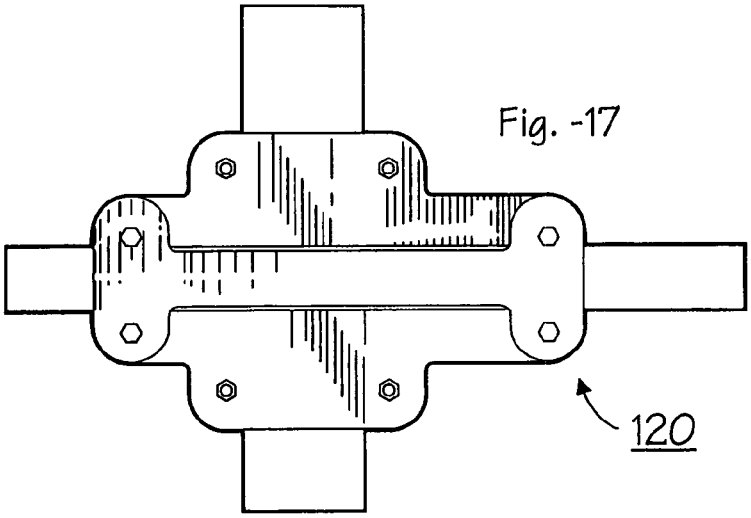

EXERCISE MACHINE

The present application claims priority from previously regularly filed Provisional U.S. Application No. 60/550,341 filed on Mar. 8, 2004 by John Vaes.

FIELD OF THE INVENTION

The following invention relates to devices for exercising and more particularly relates to a exercise machine.

BACKGROUND OF THE INVENTION

The use of free weights in exercising has been well known and used for many years. Any persons carrying out an exercise regime prefer to use free weights because of the benefit that they obtain by exercising in this manner. A number of exercise machines have attempted to emulate the motion and resistance provided by free weights, but yet provide the same exercises without having to have a full set of free weights and bars. A number of these machines attempt to emulate the muscle movements and the resistance felt by the muscles in the body when carrying out various exercises including, but not limited to biceps curls, squats, pull downs etc.

When one is doing bicep curls for example, with a free weight on a bar one not only raises the weights vertically up and down when carrying out the bicep curl, but also the weights tend to move along the horizontal plan, namely inwardly and outwardly from the body as the weights are being curled upwards. Therefore, there is both a horizontal movement component as well as a vertical movement component in a very simple exercise such as a bicep curl when they are carried out with free weights. A number of machines have attempted to emulate this motion and resistence using a compact pulley type weight resistant machine having a stack of weights. The rational behind an exercise machine is that they eliminate numerous weights and bars required with free weight lifting, as well provide for a less expensive and more compact set up and installation in a home.

Therefore, it is desirable to have a exercise machine which is capable of emulating the resistance and motion of free weight exercises in a simple, compact and inexpensive unit that can be easily installed at any location.

SUMMARY OF THE INVENTION

The present invention, an exercise machine includes:

(a) a weight stack for providing resistance to exercise movements;

(b) a moving rail which is operably connected to the weight stack, wherein the rail is independently moveable along the horizontal direction and the vertical direction; and (c) wherein the moving rail and the weight stack are operably connected to a frame.

The present invention an exercise machine includes:

a) a moveable means for operably transmitting forces to a user of said exercise machine; and b) a resistance means operably connected to said moveable means for providing resistive forces to said moveable means; and c) a frame operably supporting said moveable means and said resistance means.

Preferably wherein said moveable means independently and simultaneously moveable along an horizontal direction and vertical direction.

Preferably wherein said moveable means including a moveable section connected to the frame such that said moveable section independently and simultaneously moveable along an horizontal direction and vertical direction.

Preferably wherein the moveable section including a moving rail rollably attached to the frame with bearings.

Preferably wherein said bearings including a combination bearing mechanism for rollably connecting said moving rail to the frame such that said moving rail independently and simultaneously moveable along bearings permitting movement in the horizontal direction and vertical direction.

Preferably wherein said combination bearing mechanism including vertical rollers permitting movement of moving rail in the vertical direction and horizontal rollers for permitting movement of the moving rail in the horizontal direction.

Preferably wherein said vertical rollers operably connect the combination bearing mechanism to the frame and said horizontal rollers operably connect said moving rail to said combination bearing mechanism.

Preferably wherein said combination bearing mechanism including an outer bearing bracket, a bearing flange, and an inner bearing bracket for operably supporting said horizontal and vertical rollers.

Preferably wherein said bearings including separate horizontal bearings and vertical bearings for rollably connecting said moving rail to the frame such that said moving rail independently and simultaneously moveable along bearings permitting movement in the horizontal direction and vertical direction.

Preferably wherein said moving rail including horizontal rails connected with a cross member, wherein said horizontal rails rollably supported by the horizontal bearings such that said moving rail rollably moveable in the horizontal direction.

Preferably wherein said moving rail including a bearing cross member rigidly connecting the horizontal bearings, the bearing cross member connected to the vertical bearings such that said moving rail rollably moveable in the vertical direction.

Preferably wherein said resistance means including a weights stack operably connected to said moveable means, such that said weight stack providing resistance to movement of said moveable means.

Preferably wherein said moveable means including handles for hand gripping.

Preferably wherein said handles including rotatable grips, such that the grips rotate freely on the handle eliminating grip rotation in the hand.

Preferably wherein the moveable section including a U shaped moving rail rollably attached to the frame with bearings.

Preferably wherein the U shaped moving rail including a left horizontal rail, a spaced apart right horizontal rail and a cross member rigidly connecting the left horizontal rail to the right horizontal rail.

Preferably, wherein said frame including vertical rails for rollably receiving thereon the combination bearing mechanism such that said combination bearing mechanism rollably moveable in the vertical direction along said vertical rail.

BRIEF DESCRIPTION OF THE DRAWINGS

FIG. 14 is a partial cut away plan view of one side of the moveable section.

FIG. 15 is a front upright plan view of one side of the moveable section.

FIG. 16 is a top plan view of one side of the moveable section.

FIG. 17 is an inside upright plan view of one side of the moveable section.

DETAILED DESCRIPTION OF THE PREFERRED EMBODIMENT

Figure 1:
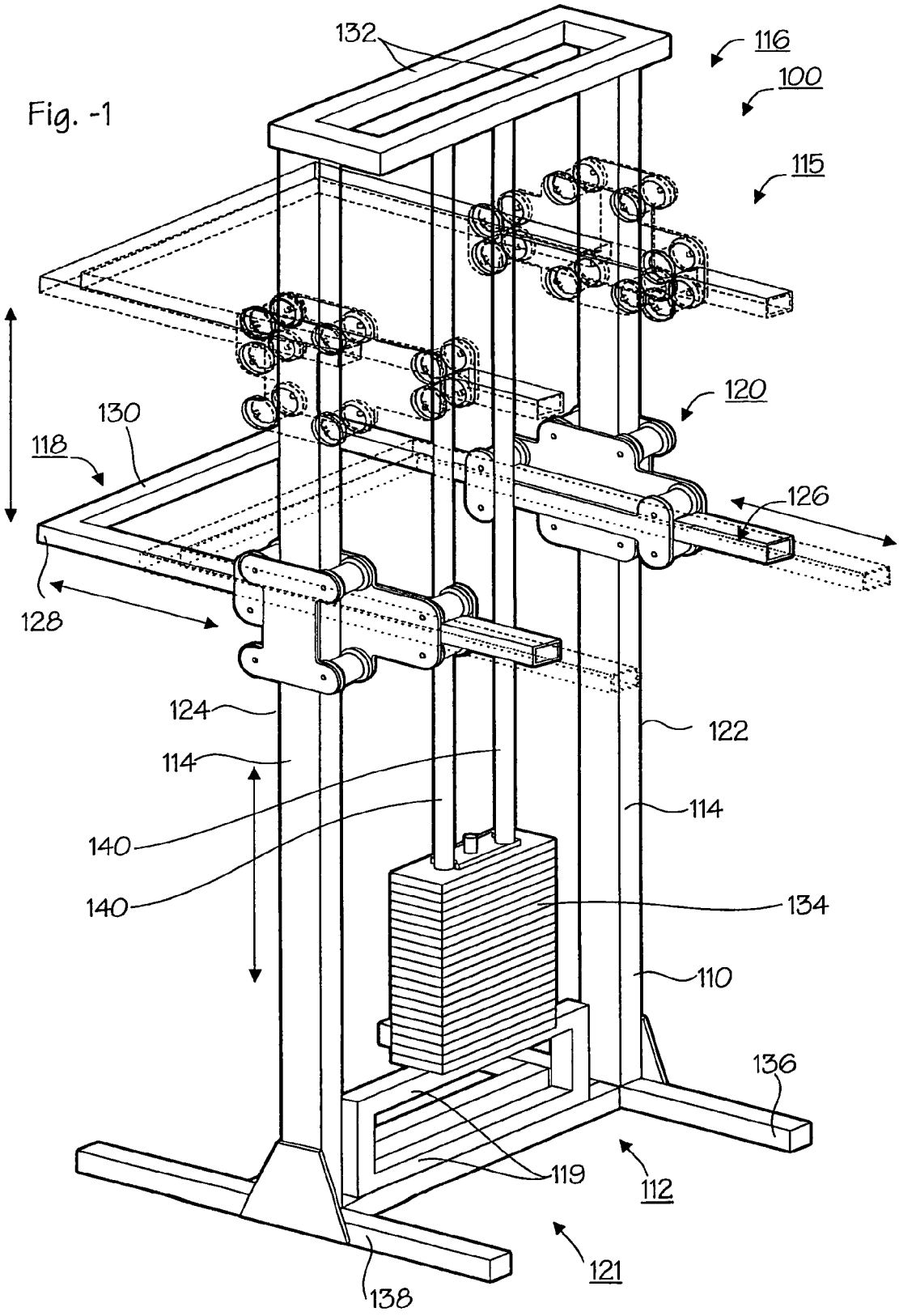
FIG. 1 is a front upright perspective view of the present invention, an exercise machine.
Figure 2:
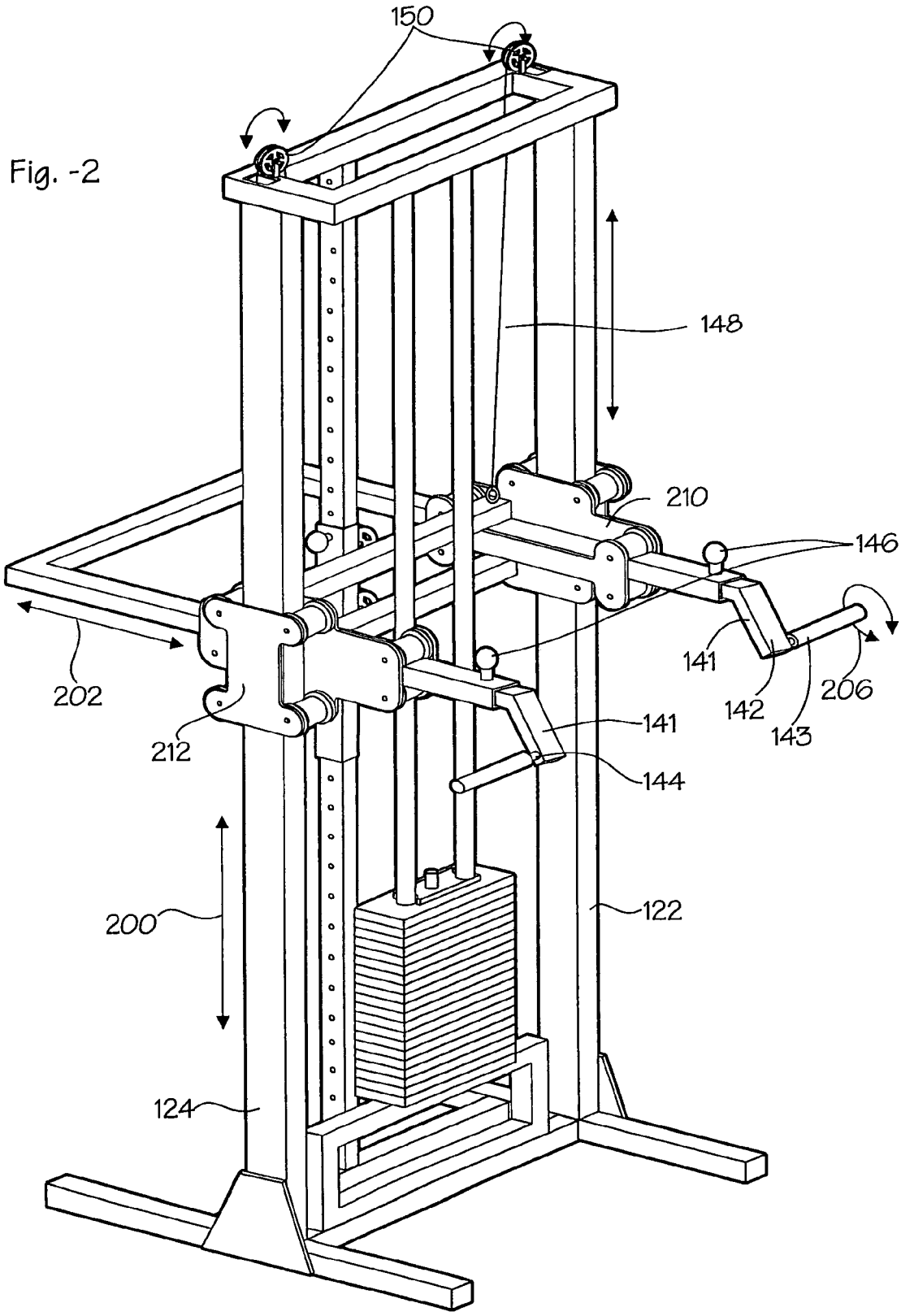
FIG. 2 is a front upright perspective view of the present invention, an exercise machine including handles attached to the moving rail.
Figure 3:
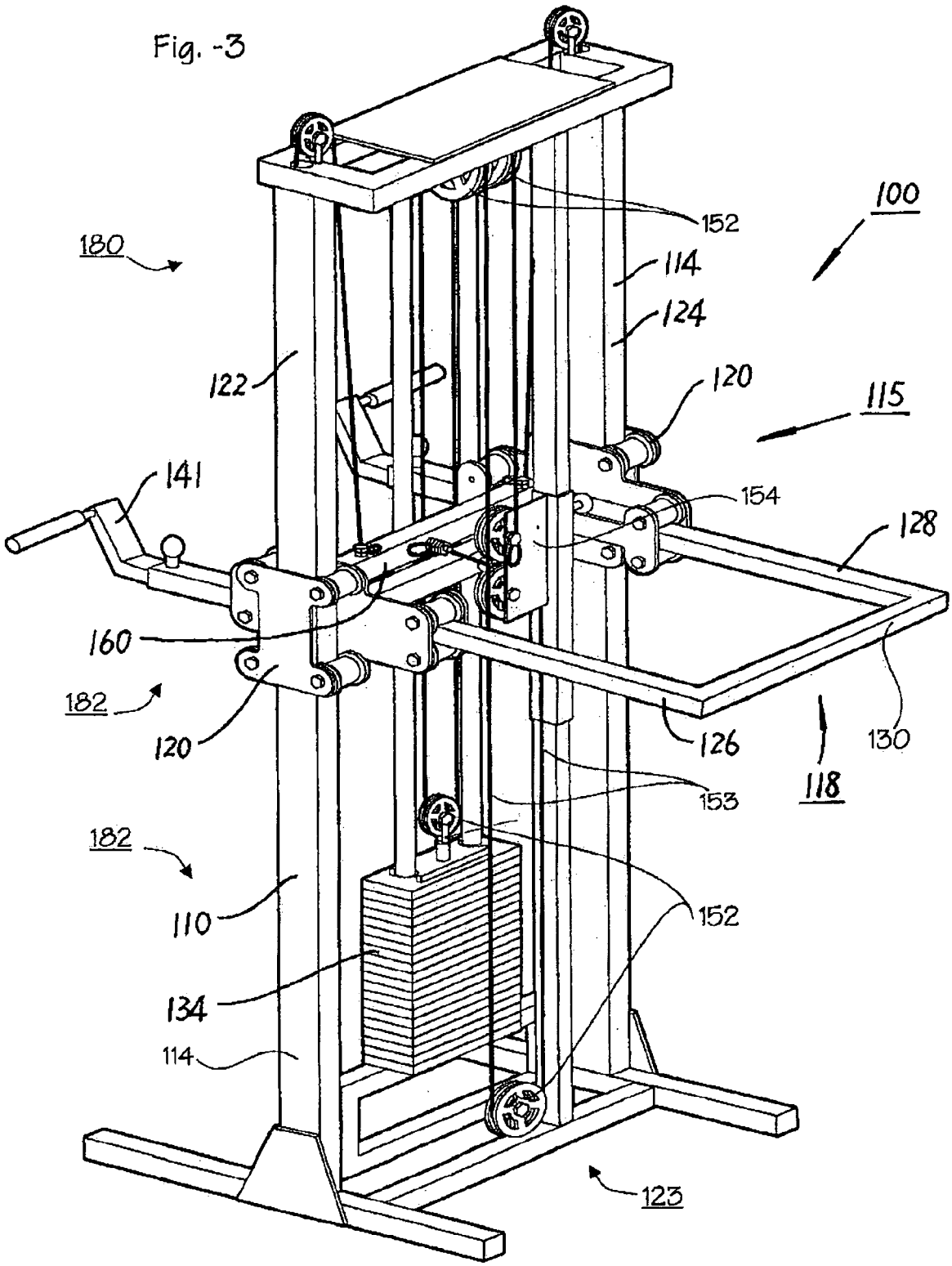
FIG. 3 is a rear upright perspective view of the present invention, an exercise machine.

Referring now to FIGS. 1, 2 and 3, the present invention, an exercise machine shown generally as 100, includes the following major components namely, frame 110 consisting of base 112, vertical rails 114, top portion 116, weight guide bar 140 and weight stack 134. Attached to frame 110 is a moveable section 115 which includes two combination bearing mechanisms 120 which are moveably attached to moving rail 118, and vertical rails 114.

Frame 110 in particular includes a right vertical rail 122, a left vertical rail 124 which are connected at the bottom to a right leg 136 and a left leg 138 respectively and at the top to stiffening members 132.

Weight guide bars 140 are connected at the bottom to cross legs 119 and at the top to stiffening members 132. Weight stacks 134 slidably move up and down along weight guide bars 140.

Exercise machine 100 generally includes a right combination bearing mechanism 210 rollably mounted onto right vertical rail 122 and a left combination bearing mechanism 212 rollably mounted onto left vertical rail 124. A U-shaped moving rail 118 is slideably mounted into each combination bearing mechanism 120 at the left side with left horizontal rail 128 and at the right side with right horizontal rail 126. The rear portion of moving rail 118 is cross member 130 connecting together left horizontal rail 128 with right horizontal rail 126.

Therefore, in the front portion of moving rail 118, handles 141 can be attached onto the right and left horizontal rails 126 and 128 respectively and locked into position using locking knobs 146.

As shown in FIG. 2, a right handle 142 and a left handle 144 are mounted respectively into a right horizontal rail 126 and a left horizontal rail 128 with locking knobs 146. Each handle includes grips 143 which rotate about a central shaft of right handle 142 such that grips 143 are free to rotate in the rotational direction shown as 206.

Therefore, moveable section 115 generally includes two combination bearing mechanisms 120, the moving rail 118 and any handles 141 which are attached into the front of the moving rail 118.

Referring now to all the figures, the static weight of movable section 115 is counter weighted through a set of counter weights 170 which are mounted slideably within the interior of each vertical rail 114 and attached to moveable section 115 through a set of counter weight pulleys 150 and counter weight wires 148 which are attached to cross bars 160 of the moveable section 115.

Figure 8:
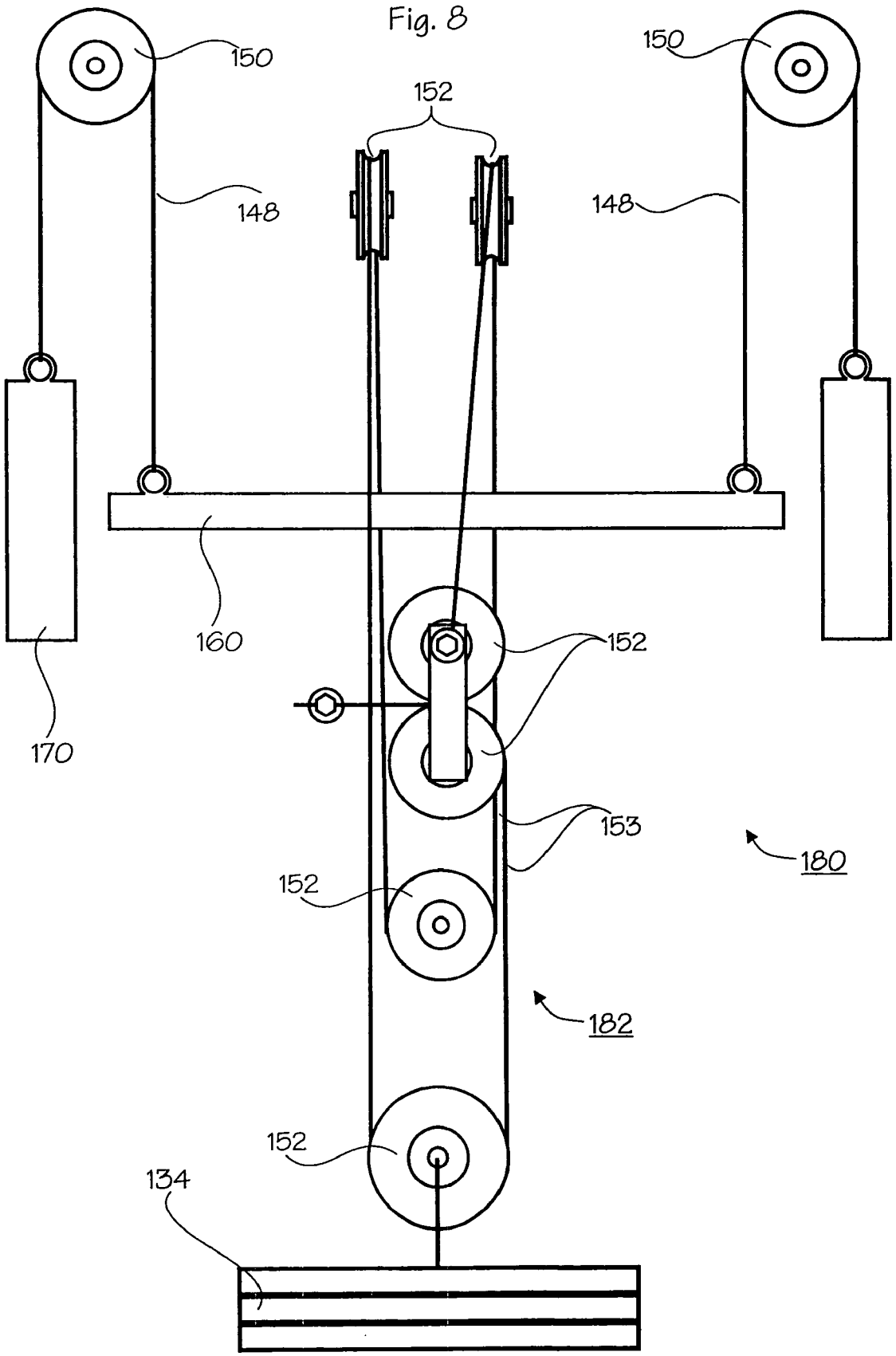
FIG. 8 is the schematic view of the pulley configuration of both the counter weight pulley system as well as the weight stack pulley system.
Figure 9:
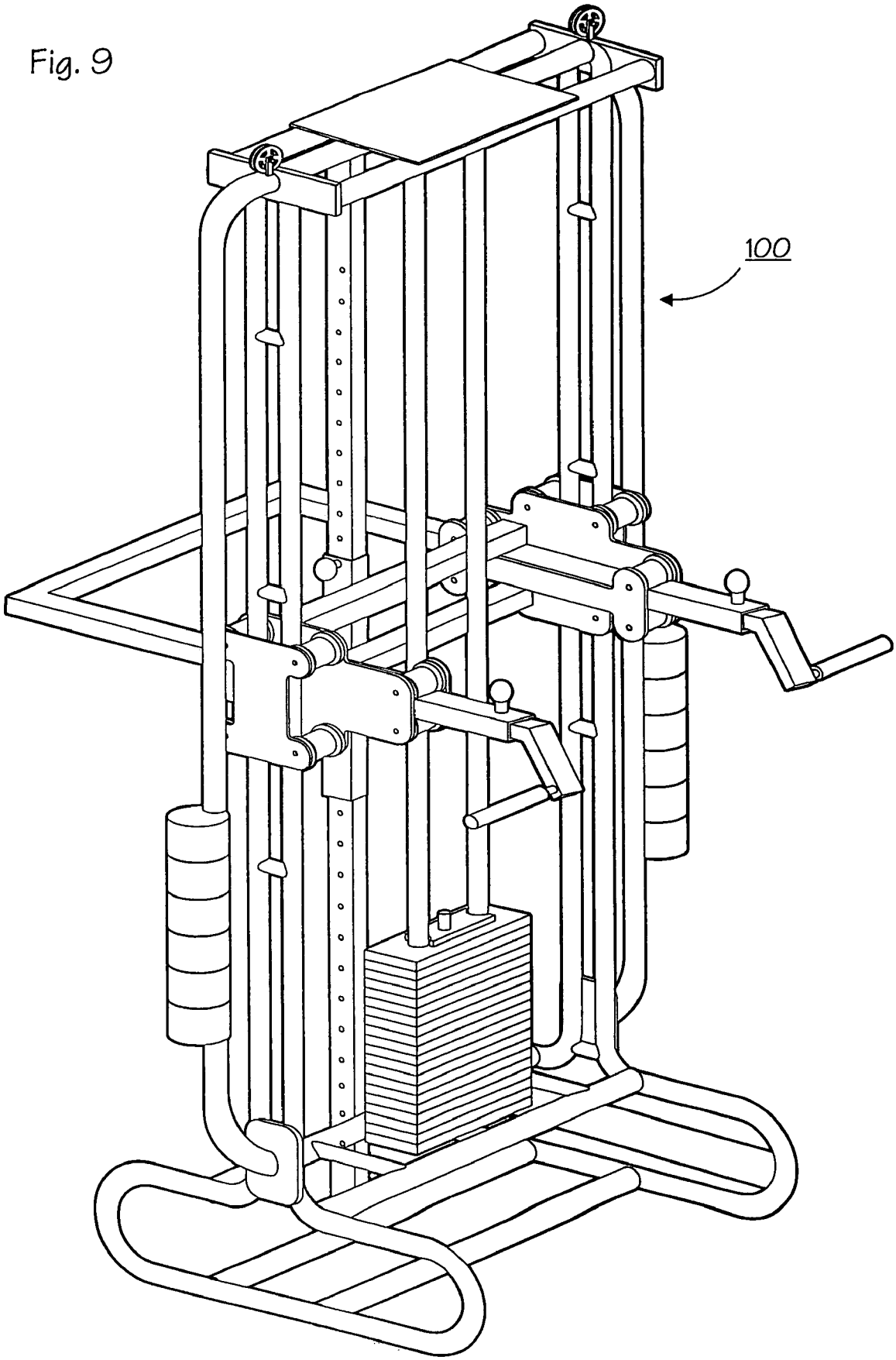
FIG. 9 is a front upright perspective view of an alternate embodiment of the present invention, an exercise machine.
Figure 10:
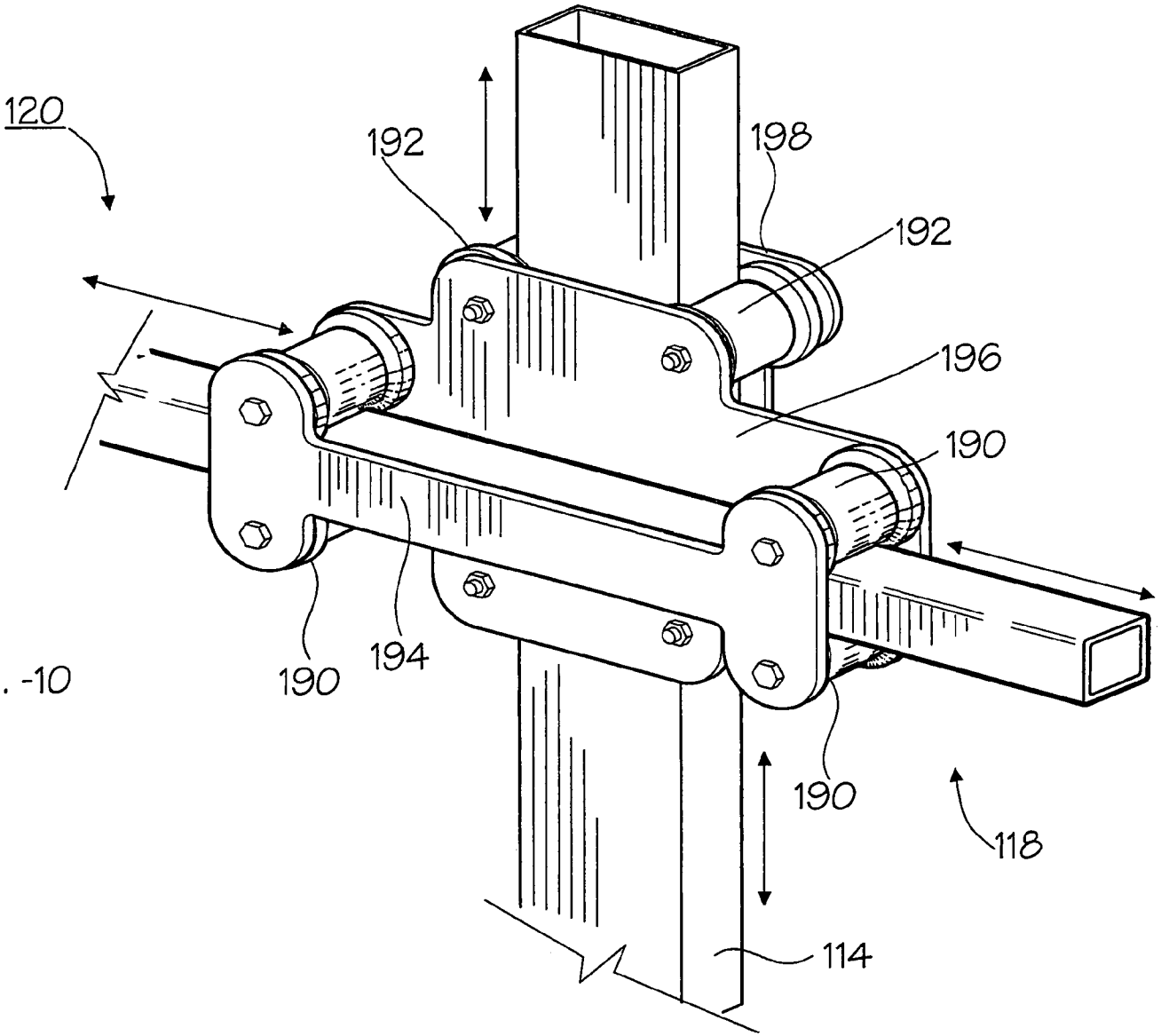
FIG. 10 is a partial assembly view of a portion of the moveable section on one of the vertical rails.
Figure 11:
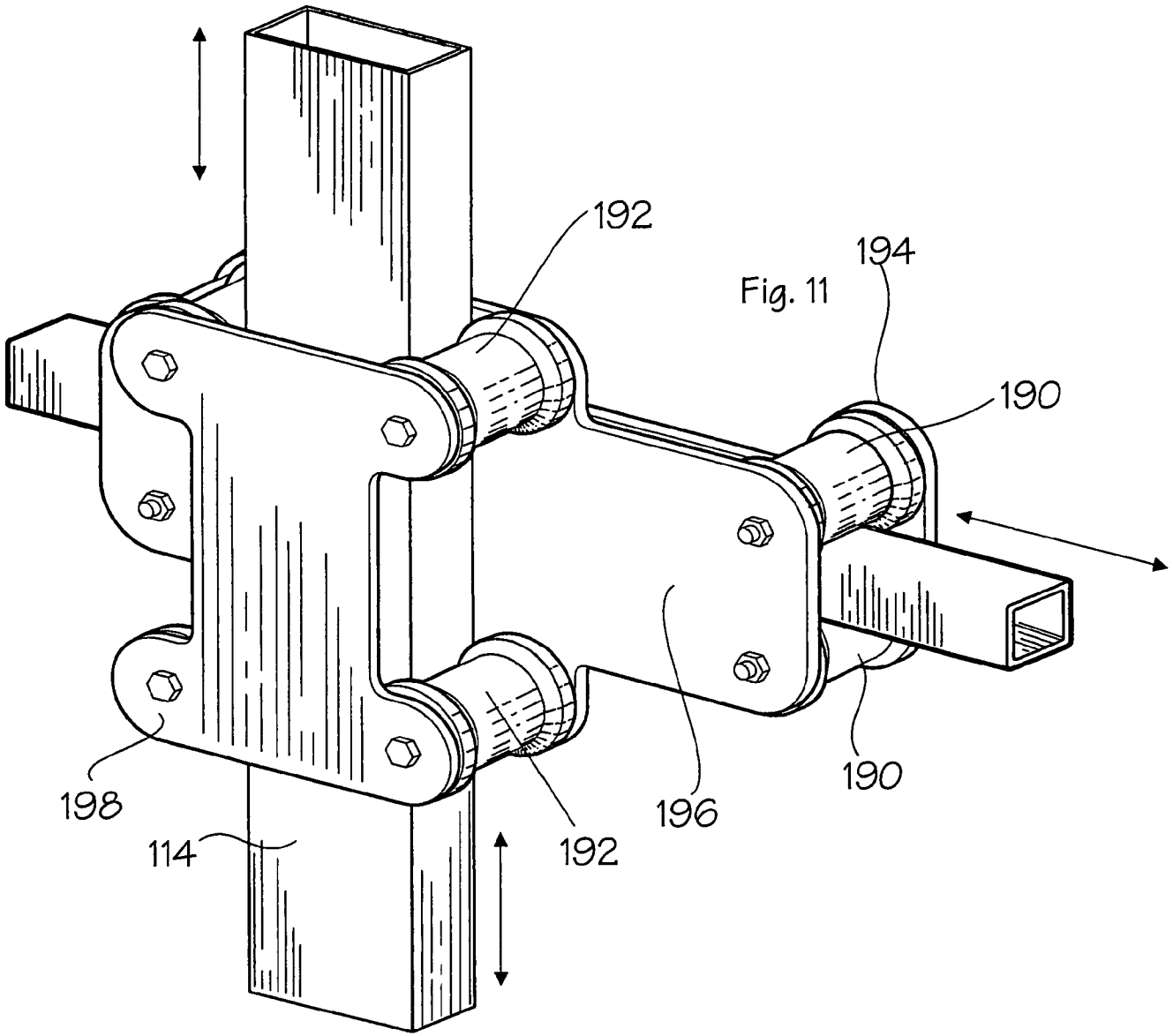
FIG. 11 is a partial assembly view of a portion of the moveable section on one of the vertical rails.
Figure 12:
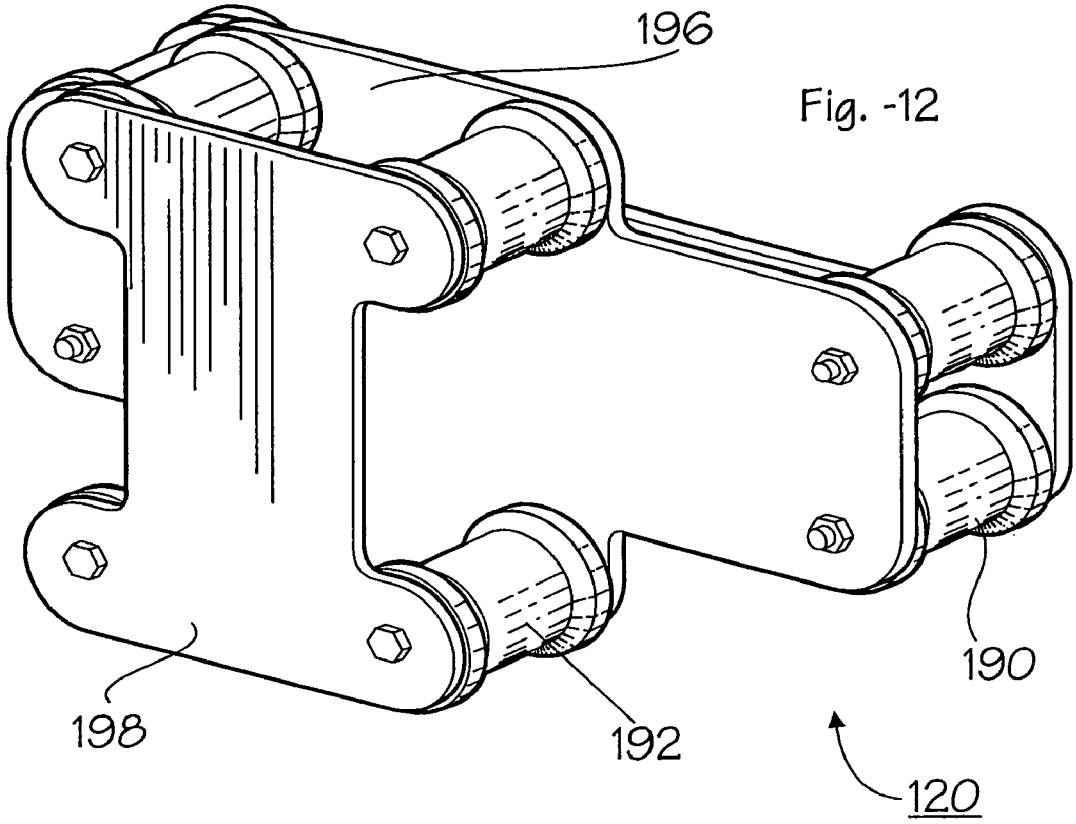
FIG. 12 is a front upright perspective view of the combination bearing mechanism.
Figure 13:
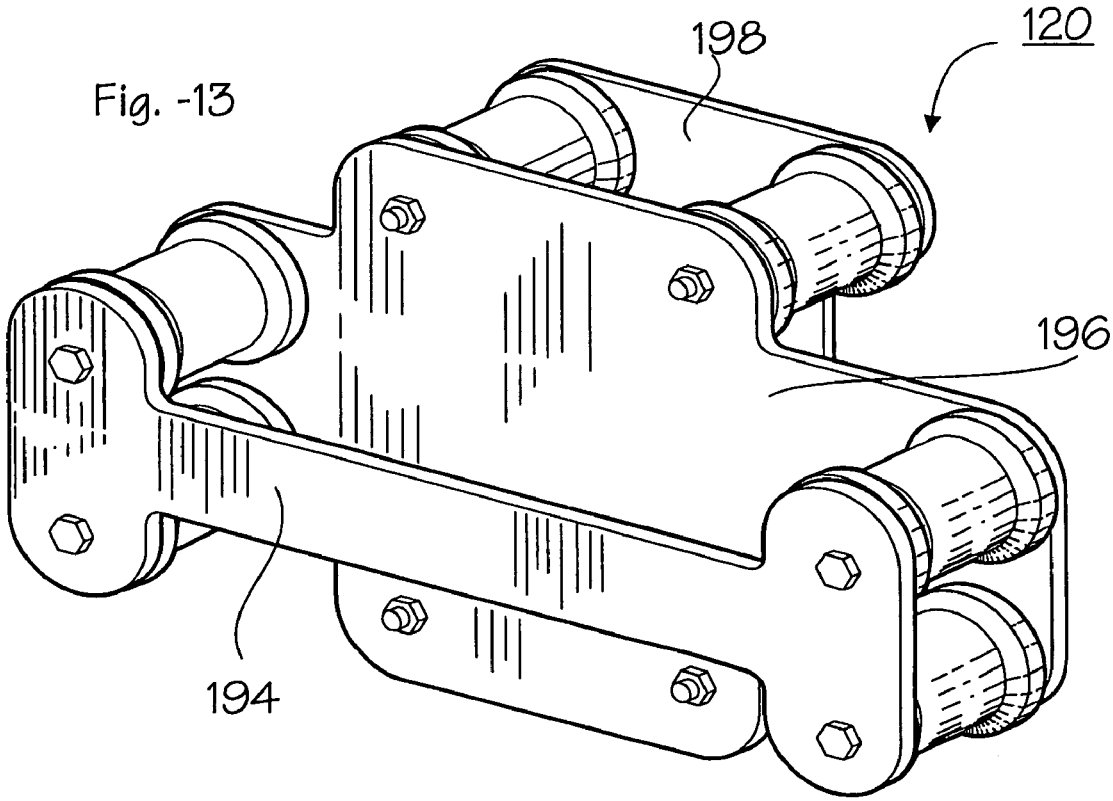
FIG. 13 is a back upright perspective view of the combination bearing mechanism.
Figure 18:
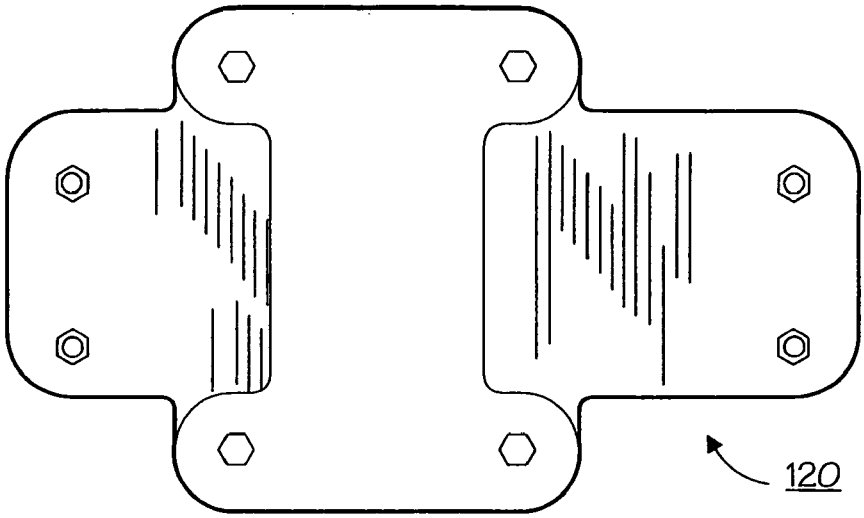
FIG. 18 is an outside elevational plan view of the combination bearing mechanism.
Figure 19:
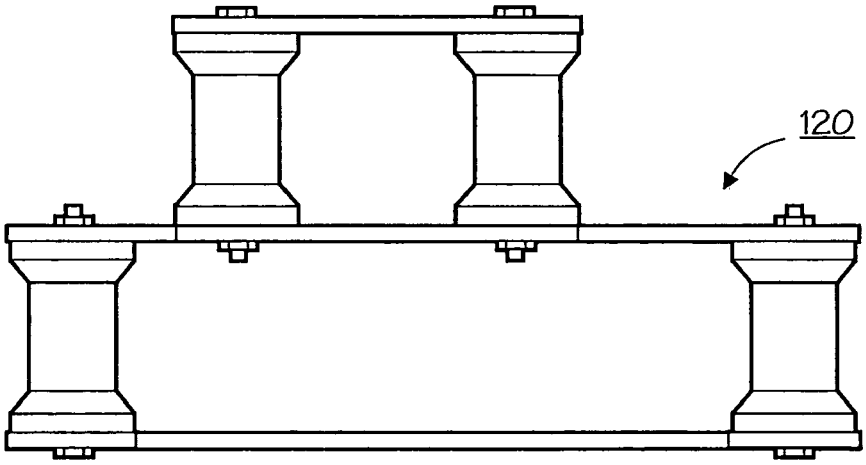
FIG. 19 is a top plan view of the combination bearing mechanism.
Figure 20:
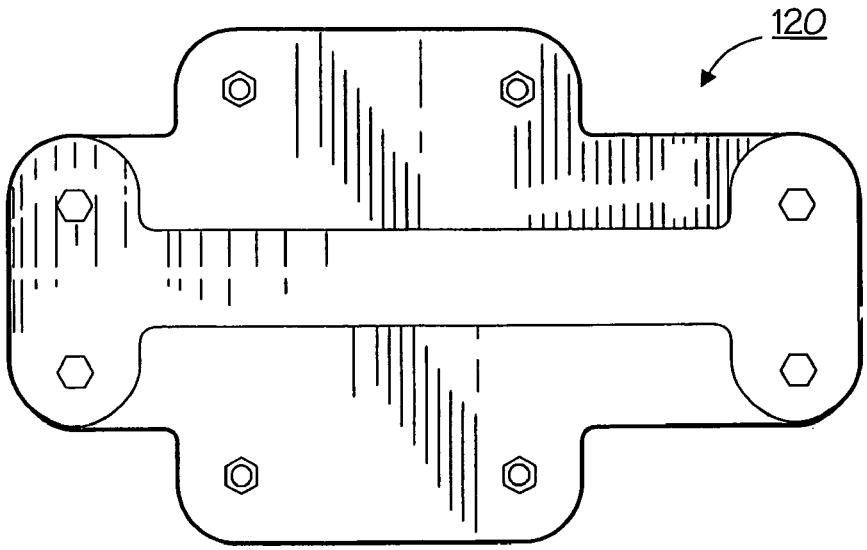
FIG. 20 is an inside upright plan view of the combination bearing mechanism.

As best shown schematically in FIG. 8, there are two independent sets of pulley systems, namely counter weight pulley system 180 which consists of counter weights 170, counter weight pulleys 150, counter weight wires 148 which are connected to cross bars 160.

The weight stack 134 is connected to the moveable section 115 via a weight stack pulley system 182 which includes weight stack pulleys 152, weight stack wires 153 and pulley flange 154.

In FIG. 3, exercise machine 100 is shown from the rear side 123 including both the counter weight pulley system 180 and the weight stack pulley system 182.

Figures 4, 5, 6:
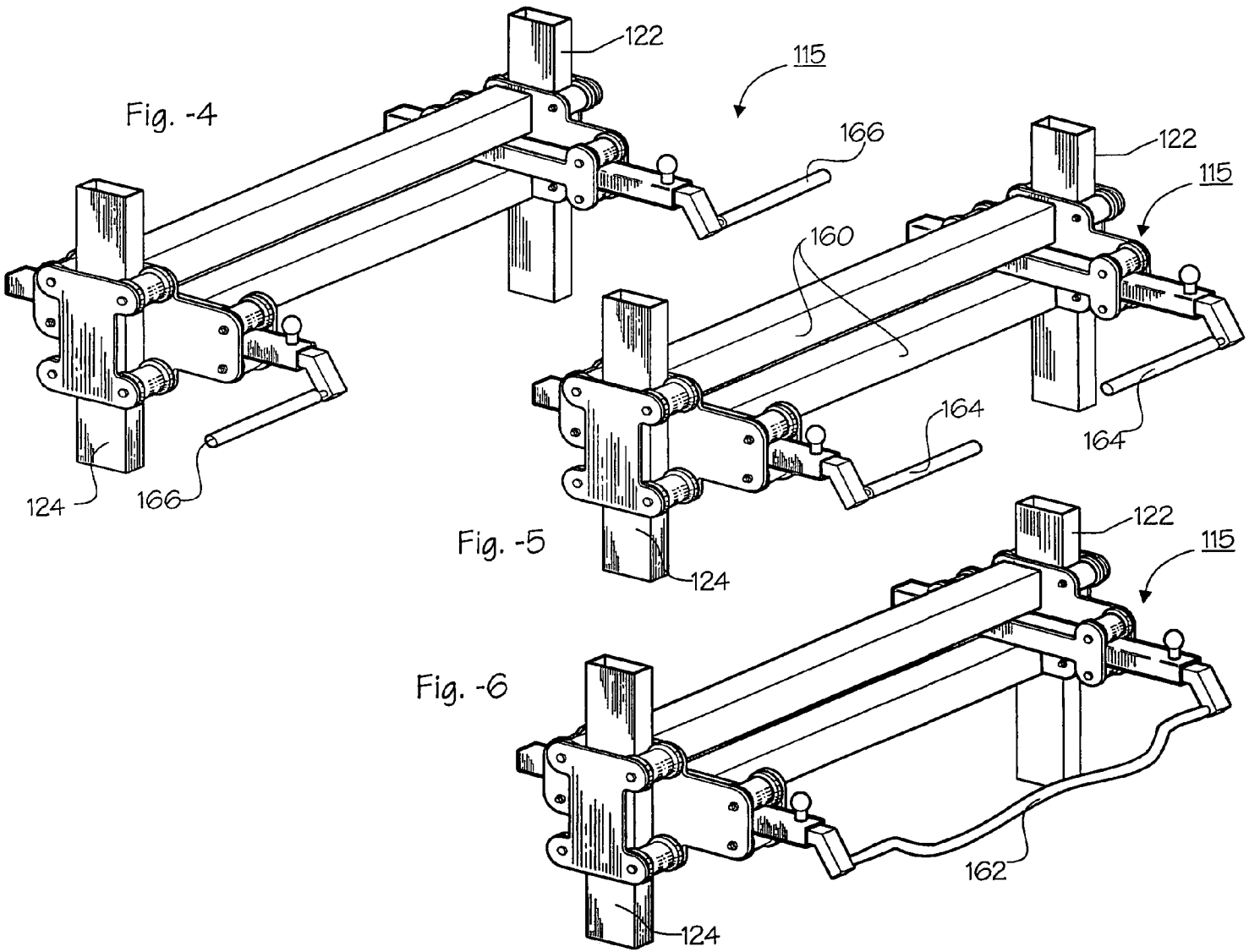
FIG. 4 is a partial cut away view of the moveable section of the exercise machine shown with out turned handles.
FIG. 5 is a partial cut away view of the moveable section of the exercise machine shown with in turned handles.
FIG. 6 is a partial cut away view of the moveable section of the exercise machine shown with an exercise bar.
Figure 7:
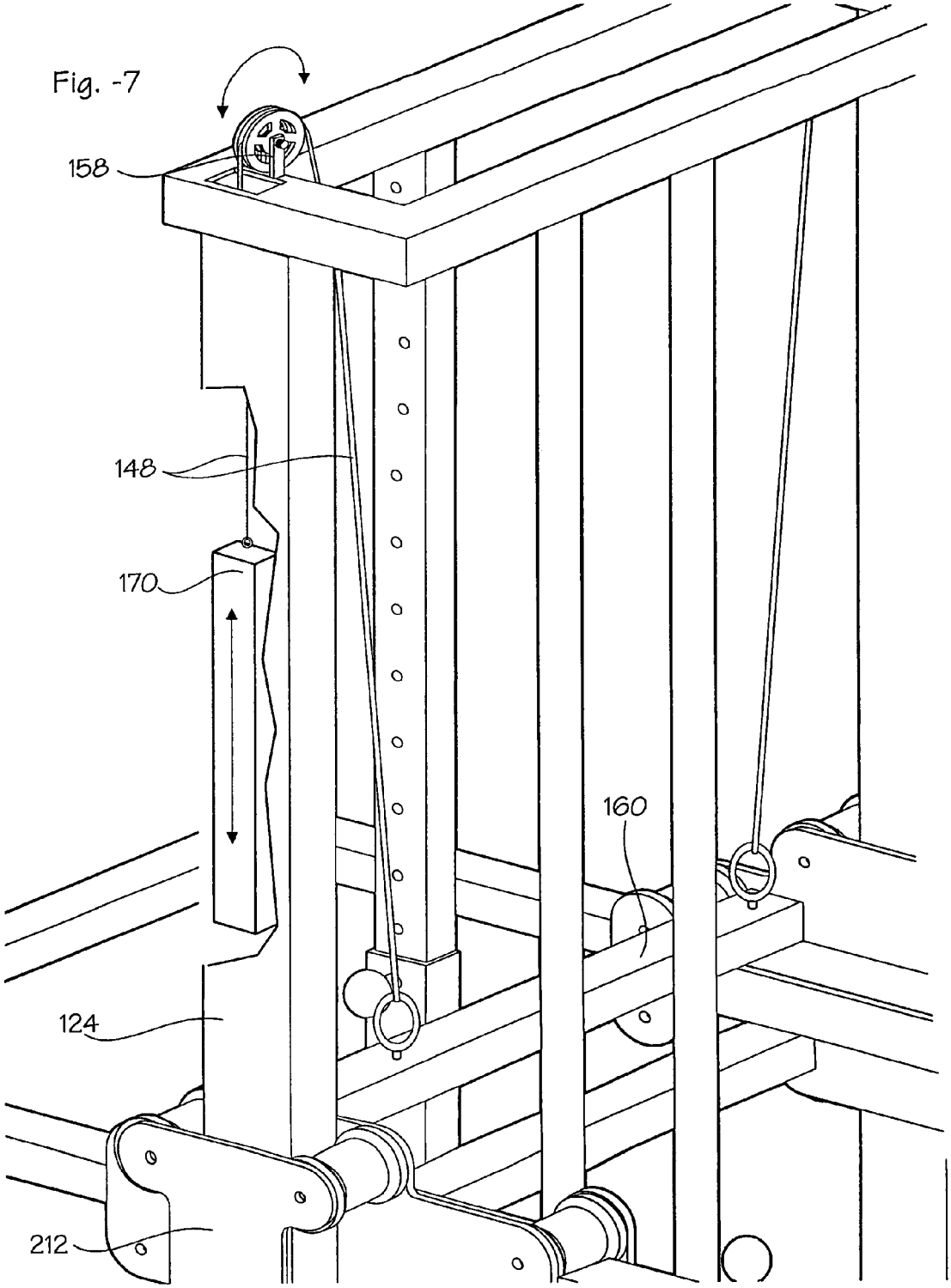
FIG. 7 is a partial cut away view of the present invention an exercise machine showing the counter weight apparatus.

Referring now to FIGS. 4, 5 and 6 which are partial views of moveable section 115 together with right and left vertical rails 122 and 124, FIGS. 4, 5 and 6 show variations of the mounting of handles 141 onto moving rail 118.

For example in FIG. 4 the handles are shown as out turned handles 166, whereas in FIG. 5 they are shown in the inturn handle position 164, whereas FIG. 6 shows a totally different handle, namely an exercise bar 162 can also be fixed to moving rail 118.

The details of combination bearing mechanism 120 are shown better in FIGS. 10, 11, 12, 13, 14, 15, 16, 17, 18, 19 and 20. Each combination bearing mechanism 120 includes horizontal rollers 190, vertical rollers 192 which are held in position with an outer bearing bracket 194, a bearing flange 196 and a inner bearing bracket 198. The horizontal rollers 190 accept rollably the right and left horizontal rails 126 and 128 there along.

Vertical rollers 192 accept rollably right and left horizontal rails 128 there along. Combination bearing mechanism 120 therefor permits movement of moveable section 115 vertically in vertical direction 200 along vertical rails 114 and also permits movement of moving rail 118 horizontally in the horizontal direction 202.

In Use

In use exercise machine 100 is gripped by user at grips 143 which are attached to handles 141 which are in turn locked onto moving rail 118 using locking knobs 146. One can apply either horizontal or vertical pressure along vertical direction 200 or horizontal direction 202, thereby raising and lowering moveable section 115 against the resistence of what ever weight is selected from weight stack 134. The vertical resistence is applied by weight stack 134 onto moveable section 115 through weight stack pulley system 182. The static weight of moveable section 115 is counter balanced via counter weights 170 which move internally in the vertical direction 200 up and down inside along right and left horizontal rails 126 and 128. There is little or no resistance to horizontal movement of moving rail 118 in horizontal direction 202.

The benefit of the present invention, exercise machine 100 is that as the exercise machine is used by either pushing upwards or downwards on handles 141, the natural movement of arms or legs and/or other parts of the body which move not only in vertical direction 200, but also along horizontal direction 202, the exercise machine 100 allows natural movement through the weight training exercise routine.

For example, when one is doing biceps curls, not only do the hands move vertically in vertical direction 200, but also as the curl is completed, there is a component of horizontal movement in horizontal direction 202 away from and closer to the persons body. Therefore, the present exercise machine 100 will allow movement of the grip both up and downwardly against resistance, but also away from and towards the users body without resistance. Moving rail 118 is independently and simultaneously moveable along an horizontal direction 202 and vertical direction 200. In this manner, the person doing the exercises can remain more or less stationary, whereas the machine will take up both vertical and horizontal movement components simultaneously.

Figure 21:
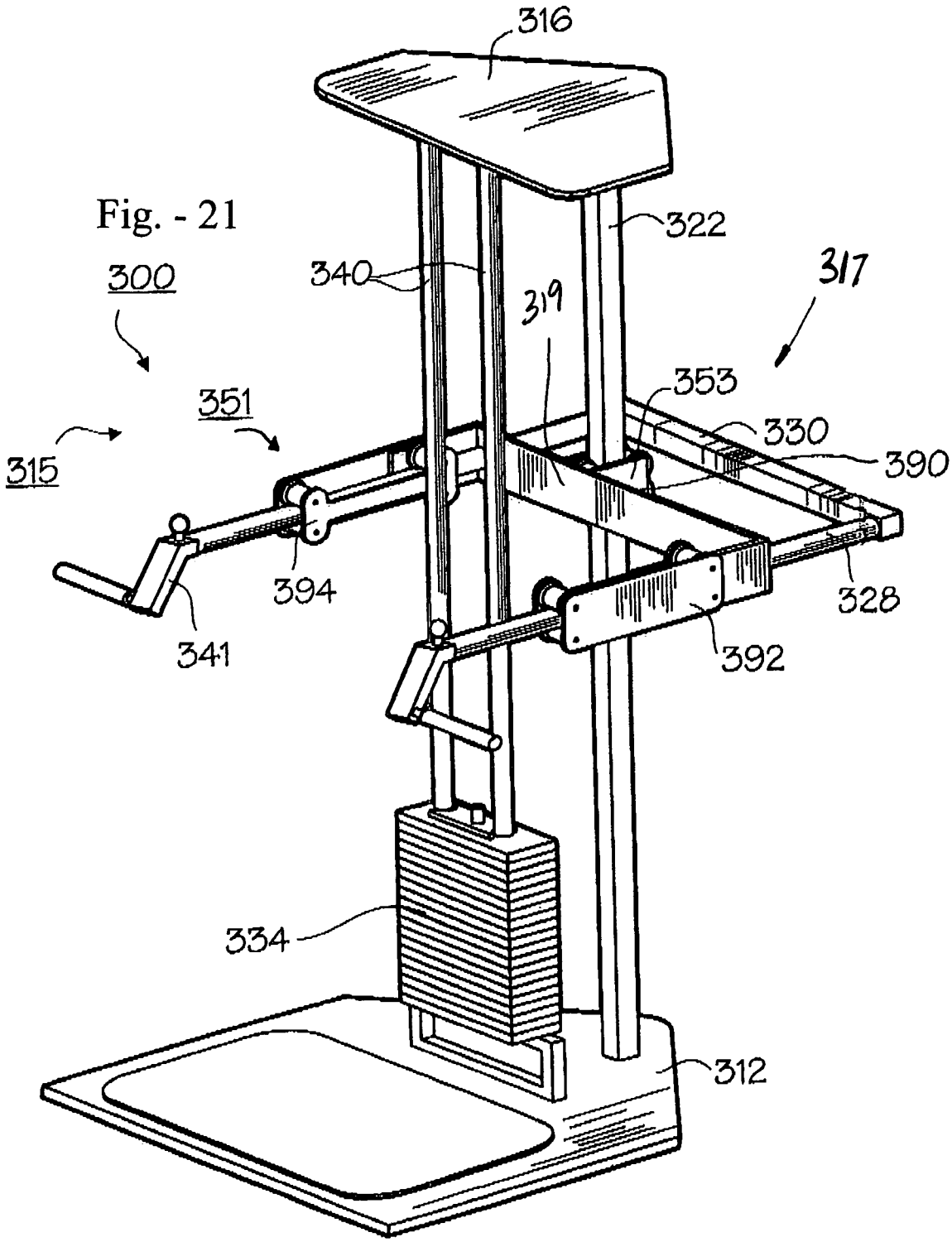
FIG. 21 is a front upright perspective view of an alternate embodiment of the present invention, an exercise machine.

An alternate embodiment of the present invention, an exercise machine as shown generally as 300 in FIG. 21. Exercise machine 300 is very similar to exercise machine 100 shown in the previous figures and is an example of how the same concept can be applied to a different geometrical set up. Exercise machine 300 includes a base 312, a vertical rail 322, a top portion 316, weight stack 334, slidable along guide bars 340 and a moveable section 315.

Moveable section 315 includes moving rail 317 including cross-member 330 rigidly connected to horizontal rails 328, slidably received within horizontal bearings 351 and bearing cross member 319 slidably connected to vertical rail 322 with vertical bearing 353. Horizontal bearing 351 includes horizontal bearing brackets 392 and 394 and vertical bearing 353 includes vertical bearing brackets 390.

In use, exercise machine 300 works in an analogues fashion to exercise machine 100 and the description above can be applied analogously. The user grips handle 341 which are connected to horizontal rails 328 and cross members 330 which are slidably received within horizontal bearing 392 and slidably attached to vertical rail 322 with vertical bearings 353. The diagram does not include the pulley arrangement for clarity, however, as in the previous embodiment, weight stack 334 is attached to moveable section 315 through a series of ropes and pulleys and counter weights not shown.

By applying upward pressure onto handle 341, moveable sections 315 is operably connected through ropes and pulleys not shown to weight stacks 334, thereby one is lifting handles 341 against the weights selected from weight stack 334. Entire moveable sections 315 moves vertically along vertical rail 322 and is supported along vertical rail 322 by vertical bearing 353. Horizontal rail 328 moves horizontally along horizontal bearings 351, when handle 341 are urged horizontally either inwardly or outwardly from exercise machine 300. Exercise machine 300 differs from exercise machine 100 in that the horizontal bearings 351 and the vertical bearings 353 are physically separated as compared to exercise machine 100, where the horizontal and vertical bearing components are combined in a combination bearing mechanism 212 for example.

It will be apparent to a person skilled in the art that the horizontal sliding component and the vertical sliding component of this type of mechanism can be integrally combined and/or separated as shown in the examples such as exercise machine 100 and exercise machine 300.

This concept could also be applied to other geometrically arrangement such as with the person laying down on ones back or a person kneeling down and/or a person arranged on their side. The example shown, the person using the exercise machine may be standing in front of it or may be laying down on ones back in front of it, and/or maybe placed in other positions in order to effectively use exercise machine 100.

It should be apparent to persons skilled in the arts that various modifications and adaptation of this structure described above are possible without departure from the spirit of the invention the scope of which defined in the appended claim.

I claim:

1. An exercise machine including:

a) a frame including a right vertical rail spaced from and parallel to a left vertical rail, b) a moveabte section rollably connected to the vertical rails of the frame for operably transmitting forces from the user to the exercise machine, c) the moveable section further including a U shaped moving rail which includes a forwardly projecting left horizontal rail and a forwardly projecting right horizontal rail rigidly interconnected at a rear portion of each horizontal rail thereof with a horizontally oriented cross member, d) the moveable section further including at least two bearing means, one for rollably connecting the right horizontal rail to the right vertical rail and one for rollably connecting the left horizontal rail to the left vertical rail such that the U channel independently and simultaneously moveable along a horizontal direction and vertical direction, e) a weight stack operably connected to the frame and the moveable section for providing resistance to vertical movement of the moveable section, f) a counter weight connected to the frame and the moveable section for counter balancing the weight of the moveable section, g) wherein the moveable section further includes at least one cross bar rigidly connecting together the bearing means for maintaining relative uniform vertical motion of the left and right horizontal rails, h) wherein the cross bar operably simultaneously connected to the weight stack and the counter weight.

2. The exercise machine claimed in claim 1, wherein the cross member limits the forward horizontal motion of the U shaped moving rail when it impinges on the bearing means.

3. The exercise machine claimed in claim 1, wherein the left horizontal rail having attached at a front portion distal end a handle and the right horizontal rail having attached at a front portion distal end a handle.

4. The exercise machine claimed in claim 3, wherein the handles limit the rearward horizontal motion of the moving rail when they impinge on the bearing means.

5. An exercise machine including:

b) a frame including a right vertical rail spaced from and parallel to a left vertical rail, b) a moveable section rollably connected to the vertical rails of the frame for operably transmitting forces from the user to the exercise machine, c) the moveable section further including a U shaped moving rail which includes a forwardly projecting left horizontal rail and a forwardly projecting right horizontal rail rigidly interconnected at a rear portion of each horizontal rail thereof with a horizontally oriented cross member, d) the moveable section further including at least two bearing means, one for rollably connecting the right horizontal rail to the right vertical rail and one for rollably connecting the left horizontal rail to the left vertical rail such that the U channel independently and simultaneously moveable along a horizontal direction and vertical direction, e) a weight stack operably connected to the frame and the moveable section for providing resistance to vertical movement of the moveable section, f) a counter weight connected to the frame and the moveable section for counter balancing the weight of the moveable section, g) wherein the moveable section further includes at least one cross bar rigidly connecting together the bearing means for maintaining relative uniform vertical motion of the left and right horizontal rails, h) wherein the cross bar further includes a rigidly attached pulley flange for operably attaching the weight stack thereto.

6. The exercise machine claimed in claim 5, wherein the pulley flange further including pulleys mounted thereon.

7. The exercise machine claimed in claim 1, wherein the bearing means including at least two combination bearing mechanisms such that the right horizontal rail connected slideably to the right vertical rail with a combination bearing mechanism and the left horizontal rail connected slideably to the left vertical rail with a second combination bearing mechanism.

8. The exercise machine claimed in claim 7, wherein the combination bearing mechanisms including vertical rollers permitting movement of U shaped moving rail in the vertical direction and horizontal rollers for permitting movement of the U shaped moving rail in the horizontal direction.

9. The exercise machine claimed in claim 1, wherein the weight stack and the counter weights independently connected to the crossbar using independent sets of wires and pulleys.

* * * * *